United States Patent [19]

Tonel

[11] Patent Number: 4,611,415

[45] Date of Patent: Sep. 16, 1986

[54] DEVICE FOR ADJUSTING FLEX IN SKI BOOTS AND THE LIKE

[75] Inventor: Valerio Tonel, Crocetta Del Montello, Italy

[73] Assignee: Nordica S.p.A., Montebelluna, Italy

[21] Appl. No.: 631,361

[22] Filed: Jul. 16, 1984

[30] Foreign Application Priority Data

Jul. 21, 1983 [IT] Italy ..... 22449/83[U]

[51] Int. Cl.[4] ..... A43B 5/04

[52] U.S. Cl. ..... 36/120; 403/120

[58] Field of Search ..... 36/117-121; 403/4, 120

[56] References Cited

U.S. PATENT DOCUMENTS

| | | | |
|---|---|---|---|
| 3,721,023 | 3/1973 | Kastinger | 36/120 |
| 3,885,329 | 5/1975 | French | 36/120 |
| 4,280,286 | 7/1981 | Sartor | 36/121 X |
| 4,334,368 | 6/1982 | Chalmers, II et al. | 36/121 |

FOREIGN PATENT DOCUMENTS

| | | | |
|---|---|---|---|
| 3319749 | 12/1983 | Fed. Rep. of Germany | 36/117 |
| 2063622 | 7/1971 | France | 36/120 |
| 2394995 | 1/1979 | France | 36/121 |
| 2433311 | 3/1980 | France | 36/121 |
| 529524 | 12/1972 | Switzerland | 36/120 |
| 2000219 | 1/1979 | United Kingdom | 403/120 |

*Primary Examiner*—James Kee Chi

*Attorney, Agent, or Firm*—Guido Modiano; Albert Josif

[57] ABSTRACT

A device for adjusting flex in ski boots and the like, comprises at least one elastic element carried on the shell of a ski boot or the like; a pivot pin is passed through the elastic element and has at least the boot front quarter connected thereto.

5 Claims, 4 Drawing Figures

DEVICE FOR ADJUSTING FLEX IN SKI BOOTS AND THE LIKE

BACKGROUND OF THE INVENTION

This invention relates to a device for adjusting flex in ski boots and the like.

It is a known fact that a problem currently affecting the manufacture of ski boots is that of providing constant flexing features, that is, of providing the ski boot with an elastic bias to the swinging movement of the quarter which can remain constant as temperature varies, or in other words, which does not grow stiffer as temperature decreases and more pliable as temperature increases.

Various arrangements are currently known which are directed to keep the boot flex constant, flex referring herein to the oscillation of the quarter relatively to the shell about a substantially horizontal axis extending perpendicularly to the shell longitudinal direction, which all have the disadvantage of being fairly expensive and of marring the outward appearance of the boot.

Such prior devices are in general of a mechanical type, and their assembly involves a high number of parts which reflect in an increased manufacturing cost.

SUMMARY OF THE INVENTION

This invention is directed to obviate such prior disadvantages by providing a device for adjusting flex in ski boots and the like, which can afford constant flexing features and irrespective of changing environmental conditions and by means of a simple, readily assembled arrangement which in no way alters the outward appearance of the ski boot.

Within the above general aim, it is an object of this invention to provide such a device which in practice does not add to the boot bulk, and affords interchangeability of some component parts to change the flex setting to suit individual preference and requirements.

Another object of the invention is to provide such a device which, by virtue of its peculiar construction, can be quite safe and reliable to use.

It is a further object of the invention to provide such a device which can be fabricated from readily available commercial items and is of moderate cost.

These and other objects, such as will be apparent hereinafter, are achieved by a device for adjusting flex in ski boots and the like, which is characterized in that it comprises at least one elastic element carried on the shell of a ski boot or the like, a pivot pin being passed through said elastic element and having at least the front quarter of said ski boot connected thereto.

BRIEF DESCRIPTION OF THE DRAWINGS

Further features and advantages of the invention will be more clearly understood from the following detailed description of this device for adjusting flex in ski boots and the like, to be read in conjunction with the accompanying illustrative drawing, where.

DESCRIPTION OF THE PREFERRED EMBODIMENTS

Figure 2:
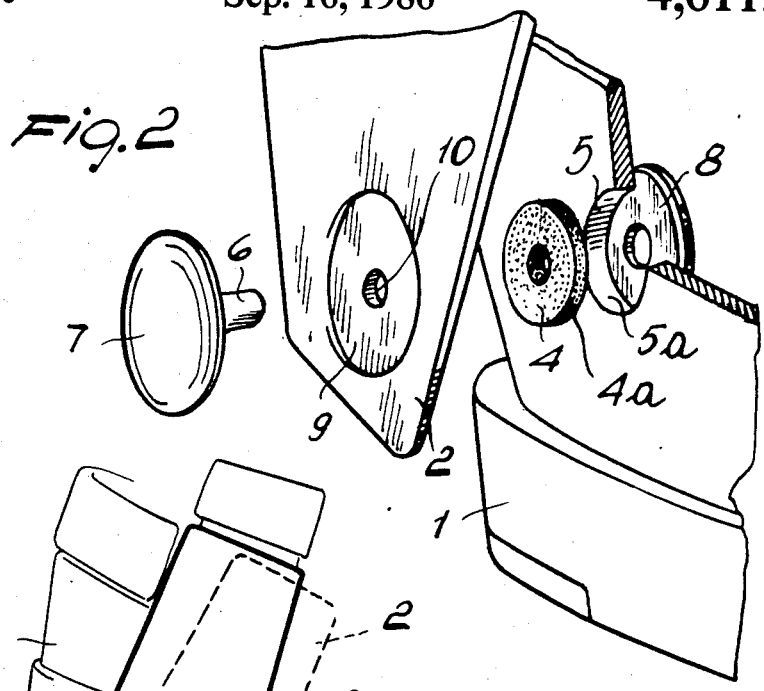
FIG. 2 is an exploded perspective view of this flex adjusting device.
Figure 1:
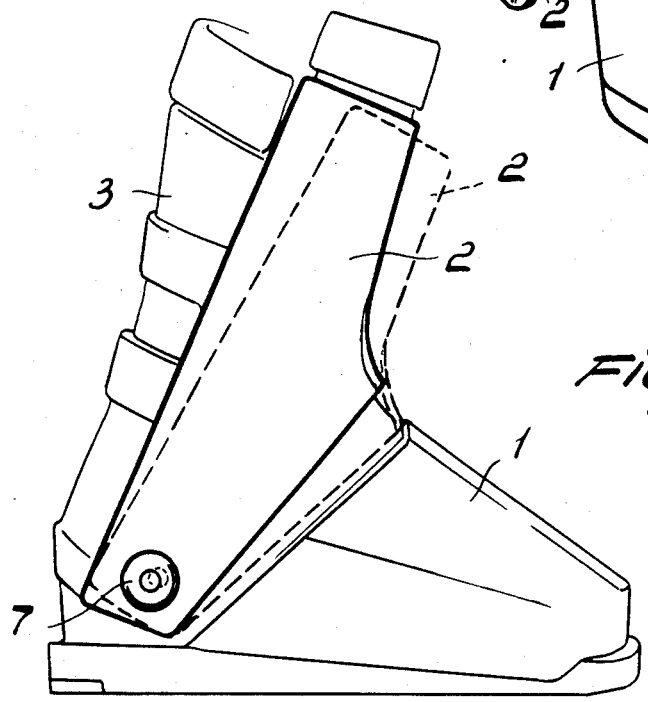
FIG. 1 shows a ski boot incorporating the adjusting device of this invention.

Making reference to the drawing views, a ski boot is shown which includes a shell 1 having a front quarter 2 and a rear quarter 3 connected thereto.

A peculiar feature of the inventive device is that both quarter are connected to the shell 1 with the interposition of this flex adjusting device, including an elastic element formed by an interchangeable pad 4 of an elastic material which is of disk-like shape and accommodated in a respective bore or seat 5 defined on the shell itself and having an inward peripheral bearing surface 5*a* against which the outward peripheral surface 4*a* of the pad 4 engages in bearing relationship therewith. The widths of both peripheral surfaces 4*a* and 5*a* extend in the direction of the axis of the bore 5.

Passed through said elastic pad 4 is a pivot pin 6 which has an outward plate 7 at one end, and its other end associable with an inward plate 8 accommodated within the shell 1.

The outward plate 7 is received in a recess 9 defined in the front quarter. The recess 9 is formed with a hole 10 therethrough wherein the pin 6 is introduced to practically form the articulating element for the front quarter; likewise, the pin 6 may engage with the rear quarter where the boot is of the opening rear quarter type.

Figure 3:
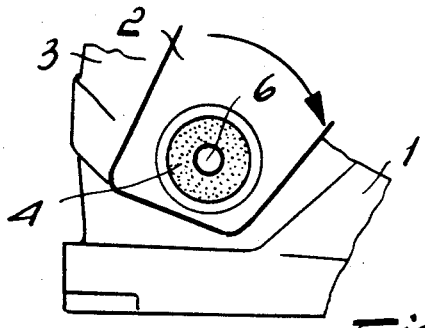
FIG. 3 illustrates the configuration assumed by the elastic element in normal conditions.
Figure 4:
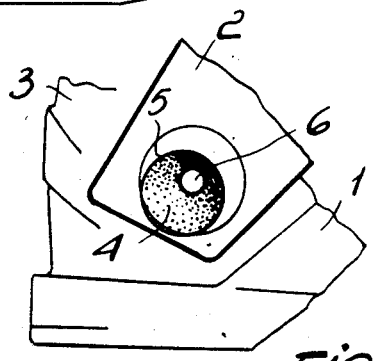
FIG. 4 illustrates the configuration assumed by the elastic element on performing a forward leaning movement.

With the above arrangement, on the skier applying a pressure in the flexing direction, the pivot pin 6 will be moved from the position shown in FIG. 3 to the position shown in FIG. 4, thus being eccentric with respect to the center of said seat and squeezing the elastic pad 4.

In other words, the flexing action exerted on the boot results in practice in a displacement of the pin which is elastically biased by the pad wherethrough the pin is passed.

It will be understood that thereby the hinged connection between the quarter 2 and the shell 1 occurs through interposition of the elastic pad 4.

By selecting the elastic pad to meet one's requirements, a preset amount of flex can be achieved which will be retained even through changes in the weather conditions and the range of boot sizes.

Of course, the elastic pads 4 may be modified within broad limits to fill different user's requirements.

It may be appreciated from the foregoing that the invention achieves its objects, and in particular that the provision of the elastic pad to function as a supporting member for the quarter pivot pin affords, by allowing an elastic displacement of the pin on flexing relatively to the shell, the faculty of setting a constant flex for the boot without involving the use of complex or at least bulky construction means.

The materials used, as well as the dimensions and contingent shapes, may be any selected ones to meet individual applicational requirements.

I claim:

1. In a ski boot, or the like, having a shell portion, at least one quarter and hinge means for hingedly connecting said quarter to said shell portion thereby to render said quarter tiltable with respect to said shell portion about an axis transverse to the longitudinal extension of the ski boot, a device for adjusting the flex of the ski boot, the device comprising as components parts of said hinge means:

means defining a seat in said shell around said axis, an elastic element arranged within said seat, said elastic element having a bore normally coaxial with said axis and an outward peripheral surface the width of which extends in the direction of said axis and in bearing relationship with said seat, a pivot pin extending through said bore of said elastic element and secured to said quarter, thereby the hinged connection and supporting of said quarter onto said shell portion occurring through interposition of said elastic element between said pin and said seat.

2. A device according to claim 1, wherein said seat is in the form of a circular bore having a circular inward peripheral surface the width of which extends in the direction of said axis and wherein said elastic element is in the form of a circular disk, said outward peripheral surface thereof being normally a cricular peripheral surface in bearing relationship with said inward periphery.

3. A device according to claim 1, wherein said pivot pin has on one end thereof an outward plate portion and said shell has a through hole coaxial with said axis and an outward recess around said hole for receiving therein said outward plate portion and wherein said pivot pin has an inward plate portion on the other end thereof located at the inside of said shell.

4. A device according to claim 1, wherein the ski boot further comprises a rear quarter and a front quarter and wherein said pivot pin is connected is connected to said front quarter and to said rear quarter.

5. A device according to claim 1, wherein said seat is in the form of a circular bore having a circular inward peripheral surface defining a center thereof and wherein in at least one flexed condition said pivot pin is eccentric with respect to said center and said elastic element is at least partly in squeezed condition.

* * * * *